US009048075B1

(12) United States Patent
Kodera

(10) Patent No.: US 9,048,075 B1
(45) Date of Patent: Jun. 2, 2015

(54) TIME-OF-FLIGHT TYPE MASS SPECTROMETER

(71) Applicant: SHIMADZU CORPORATION, Kyoto-shi, Kyoto (JP)

(72) Inventor: Kei Kodera, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 14/154,722

(22) Filed: Jan. 14, 2014

(51) Int. Cl.

| | |
|---|---|
| ***H01J 49/40*** | (2006.01) |
| ***H01J 49/04*** | (2006.01) |
| ***H01J 49/02*** | (2006.01) |
| ***H01J 49/16*** | (2006.01) |

(52) U.S. Cl.
CPC ..... *H01J 49/022* (2013.01); *H01J 49/40* (2013.01); *H01J 49/164* (2013.01); *H01J 49/403* (2013.01)

(58) Field of Classification Search
CPC ..... H01J 49/40; H01J 49/061; H01J 49/0095; H01J 49/0409; H01J 49/403; H01J 49/0031; H01J 37/08
USPC ..... 250/281, 282, 287
See application file for complete search history.

(56) References Cited

U.S. PATENT DOCUMENTS

| | | | | |
|---|---|---|---|---|
| 4,912,327 | A * | 3/1990 | Waugh | 850/9 |
| 5,034,605 | A * | 7/1991 | Bayly | 850/9 |
| 5,650,616 | A * | 7/1997 | Iketaki | 250/288 |
| 6,462,337 | B1 * | 10/2002 | Li et al. | 250/288 |
| 8,759,756 | B2 * | 6/2014 | Iwasaki | 250/287 |
| 2006/0138316 | A1 * | 6/2006 | Seydoux et al. | 250/282 |
| 2007/0029474 | A1 | 2/2007 | Cotter et al. | |
| 2007/0221843 | A1 * | 9/2007 | Ward et al. | 250/309 |
| 2008/0001081 | A1 * | 1/2008 | Jindai et al. | 250/287 |
| 2011/0147578 | A1 * | 6/2011 | Schultz et al. | 250/282 |
| 2014/0224979 | A1 * | 8/2014 | Kyogaku et al. | 250/282 |
| 2014/0374587 | A1 * | 12/2014 | Murayama et al. | 250/282 |

FOREIGN PATENT DOCUMENTS

| | | | |
|---|---|---|---|
| JP | 11-185697 | A | 7/1999 |
| JP | 2007317378 | A | 12/2007 |
| JP | 2009-052994 | A | 3/2009 |
| JP | 2010251174 | A | 11/2010 |

* cited by examiner

*Primary Examiner* — David A Vanore
(74) *Attorney, Agent, or Firm* — Sughrue Mion, PLLC

(57) ABSTRACT

A time-of-flight type mass spectrometer in which, at the time when ions are generated by irradiating a sample with a laser beam, an extraction electric field having a potential gradient that decreases gradually from a sample plate toward an extraction electrode is formed. Ions are roughly separated in accordance with the m/z in the extraction region due to the effect of this electric field, and ions with a large m/z remain near the sample. The voltages applied to the sample plate and an auxiliary electrode are increased after a delay time has passed so as to form an acceleration electric field having a potential gradient with a polygonal line pattern. Since this electric field is similar to an ideal potential gradient curve, it is possible to provide the ions with appropriate potential energy changes for each m/z, improving resolution by appropriately realizing energy convergence over a wide m/z range.

2 Claims, 8 Drawing Sheets

TIME-OF-FLIGHT TYPE MASS SPECTROMETER

CROSS-REFERENCE TO RELATED APPLICATIONS

The entire contents of Japanese Patent Publication No. 2013-041699 to the same inventors, published Feb. 28, 2013, are incorporated herein by reference.

TECHNICAL FIELD

The present invention relates to a time-of-flight type mass spectrometer and more particularly to an ion source using an ionization method such as matrix assisted laser desorption/ionization in a time-of-flight type mass spectrometer.

BACKGROUND ART

A time-of-flight type mass spectrometer (hereinafter called a "TOFMS") typically introduces ions accelerated by an electric field into a flight space that does not have an electric field or a magnetic field, allowing the ions to fly freely, and then separates various ions by each mass/charge ratio m/z in accordance with the time of flight until the ions reach a detector. In order to enhance the mass resolution in the TOFMS, it is necessary to increase the flight distance, and known configurations for achieving this include, in addition to a linear configuration in which ions are simply allowed to fly linearly, a reflectron configuration in which ions are allowed to make a return flight using an electric field or a magnetic field and a multi-turn configuration in which ions are allowed to make a plurality of roughly identical closed orbits.

A matrix assisted laser desorption/ionization (MALDI) ion source based on the MALDI method is widely used as a TOFMS ion source. In the MALDI method, a sample is prepared, for example, by mixing a solution of a substance to be measured with a matrix solution, mixing a separate ionization auxiliary agent into the solution if necessary, applying the solution to a sample plate, and removing the solvent by drying or the like. A sample prepared in this way is in a state in which the substance to be measured is practically uniformly mixed with a large quantity of a matrix. When this sample is irradiated with a laser beam, the matrix absorbs the energy of the laser beam and converts the energy into thermal energy. At this time, part of the matrix is rapidly heated and vaporized together with the substance to be measured, and the substance to be measured is ionized in this process.

In a TOFMS using a MALDI ion source, various ions generated from the sample due to the aforementioned laser beam irradiation are extracted from the vicinity of the sample by the effect of the electric field, and these ions are accelerated and fed into the flight space. In order to achieve high mass resolution, it is necessary for the initial speeds of the same types of ions (having identical mass/charge ratios) to be aligned when the ions are introduced into the flight space. However, in a MALDI ion source, there is typically large variation in the initial energy of ions at the point when the ions are generated, which leads to large variation in the initial speed and diminishes the time convergence. Therefore, a technique called delayed extraction is widely used to avoid this problem (see Patent Literatures 1, 2, and the like).

FIG. 6 is a schematic view for explaining the ion extraction operation using delayed extraction. As illustrated in FIG. 6(*a*), a sample S in which a matrix is mixed is held on an electrically conductive sample plate 1, and the sample S is irradiated with a laser beam for ionization for a short period of time. Ions flying out of the sample S due to laser beam irradiation are extracted to the right in the drawing from the vicinity of the sample S and fed to a flight space not illustrated in the drawing due to the effect of an electric field formed by a voltage applied to an extraction electrode 3 and a base electrode 4*c* disposed opposite the sample plate 1.

More specifically, at the point in time when the sample S is irradiated with the laser beam, the same voltage VE is applied to both the sample plate 1 and the extraction electrode 3, and a prescribed base voltage VB is applied to the base electrode 4*c*. The base electrode 4*c* is typically grounded, so VB=0 in this case. As a result, the potential distribution on the ion optical axis C is as illustrated in FIG. 6(*b*). That is, since there is no potential gradient (meaning that there is essentially no electric field) in the extraction region between the sample plate 1 and the extraction electrode 3, the ions generated from the sample S due to laser beam irradiation are not accelerated. In this state, the sample S moves farther away (moving to the right in the drawing) when the ions have a larger initial energy at the time of ion generation, so at the point when a certain amount of time has passed after ion generation, the sample S is located closer to the extraction electrode 3 when the ions have a larger initial energy, regardless of the mass/charge ratios of the ions.

Once a certain delay time (ordinarily approximately several tens to several hundreds of nsec) has passed after laser beam irradiation, voltage applied to the sample plate 1 is increased stepwise from VE to VS. As a result, as illustrated in FIG. 6(*c*), an electric field having a downward-sloping potential gradient from the sample plate 1 toward the extraction electrode 3 is formed in the extraction region. Various ions that had been present in the extraction region immediately before are simultaneously accelerated by this electric field. At this time, the acceleration voltage is higher for ions at positions closer to the sample plate 1—that is, ions with a smaller initial energy—so the kinetic energy provided to the ions is large. Accordingly, ions with a smaller initial energy at the time of ion generation are fed into the flight space at a greater speed, even if the ions are of the same type, so while the ions introduced into the flight space with a delay are flying, the ions gradually catch up to preceding ions of the same type with a relatively large initial energy and ultimately reach the detector at roughly the same time. The effects of fluctuation in initial energy among ions of the same type are thus eliminated, which makes it possible to achieve high time convergence.

The above is the principle of the time convergence enhancing effect of a typical delayed extraction method used conventionally. However, such delayed extraction has the following such problems. Specifically, the correction of fluctuation in the initial energy described above is achieved by correcting the kinetic energy by changing the potential energy of each ion. The average value of the initial speed (or initial energy) of the ions generated from the sample S by laser beam irradiation is roughly constant, regardless of the mass/charge ratio. Therefore, the energy required for correction is proportional to the mass/charge ratio, and the voltage value required for correction (potential difference ΔV with VE in FIG. 6(*c*)) also depends on the mass/charge ratio. On the other hand, the ions are generated within a very small space near the surface of the sample S, and the electric field does not act on the extraction region during a free movement period until the voltage applied to the sample plate 1 is increased from VE to VS when delayed extraction is executed, so the spatial distribution of the ions at the time when the acceleration voltage is applied after a certain delay time has passed is unrelated to the mass/ charge ratio. FIG. 8(*b*) is a conceptual diagram illustrating the spatial distribution of ions at this time.

In order to increase the time convergence of ions of the same type so as to enhance mass resolution, it is necessary to correct fluctuation in the initial energy appropriately, so it is necessary to apply an appropriate acceleration voltage (potential difference ΔV described above) to the ions for each mass/charge ratio. However, since the spatial distribution of the ions at the time of the application of the acceleration voltage is unrelated to the mass/charge ratio, although appropriate correction is possible for types of ions having certain mass/charge ratios when the acceleration voltage is set to a certain value, sufficient correction is not possible for types of ions having other mass charge/ratios. Therefore, the mass/charge ratio range over which the mass resolution is improved by conventional delayed extraction is limited, which leads to the problem that it is difficult to improve the mass resolution over a wide mass/charge ratio range.

Here, a MALDI ion source is used as an example of an ion source, but the same problem arises even with ion sources of other ionization methods used as TOFMS iron sources—for example, a laser desorption ionization (LDI) method that does not use a matrix, a secondary ion mass spectrometry (SIMS) method, a desorption electrospray ionization (DESI) method, a plasma desorption ionization method (PDI), or the like—configured so as to generate ions from a sample during a short period of time, extract and accelerate the ions with an electric field, and feed the ions into a flight space.

PRIOR ART LITERATURES (PATENT LITERATURE 1) Japanese Unexamined Patent Application Publication H11-185697

(PATENT LITERATURE 2) Japanese Unexamined Patent Application Publication 2009-52994

SUMMARY OF THE INVENTION

In light of the problems described above, the inventor of this application proposed a novel delayed extraction method that can be applied to a MALDI ion source or the like in Japanese Patent Application 2010-39883. FIG. 7 is a conceptual diagram for explaining the principle of the operation of this novel delayed extraction method (hereinafter called a "slope field delayed extraction method").

In this slope field delayed extraction method, when generating ions by irradiating the sample S with a laser beam, an electric field having a potential gradient which decreases gradually from the sample plate 1 toward the extraction electrode 3 is formed by applying not VE but a voltage VS1 that is higher than VE to the sample plate 1 (see FIG. 7(*b*)). As described above, ions generated in the vicinity of the surface of the sample S have an initial speed that is independent of the mass/charge ratio, but the ions also have a speed corresponding to the mass/charge ratio due to the effects of the electric field demonstrating a potential gradient. Therefore, ions with a smaller mass/charge ratio move farther away from the sample S, and ions with a larger mass/charge ratio remain in the vicinity of the sample S. FIG. 8(*a*) is a conceptual diagram illustrating the spatial distribution of ions at this time.

When the voltage applied to the sample plate 1 is then increased from VS1 to VS2 after a prescribed delay time has passed after laser beam irradiation (see FIG. 7(*c*)), ions with a large mass/charge ratio present at positions near the sample plate 1 receive a relatively large acceleration energy in comparison to ions with a small mass/charge ratio. As a result, it is possible to provide the ions with appropriate changes in potential energy for each mass/charge ratio, so it is possible to improve the mass resolution by appropriately realizing energy convergence over a wider mass/charge ratio range than in the conventional delayed extraction method.

However, in the slope field delayed extraction method described above, the correction of the acceleration energy is not necessarily sufficient for ions with a mass/charge ratio larger than a certain level due to the reasons described below, and as a result, there is a limit to the expansion of the mass/charge ratio range over which the mass resolution can be improved.

The present invention was conceived in light of this issue, and the object of the present invention is to improve the mass resolution of a time-of-flight type mass spectrometer equipped with an ion source for extracting and generating ions generated from a sample using a delayed extraction method by appropriately correcting fluctuations in the initial energy of ions over an even wider mass/charge ratio range than with the typical delayed extraction method used conventionally or the slope field delayed extraction method.

The present invention, which was conceived in order to solve the problems described above, is a time-of-flight type mass spectrometer for accelerating ions generated from a sample, introducing the ions into a flight space, and separating and detecting the ions in accordance with a mass/charge ratio within the flight space, the time-of-flight type mass spectrometer including:

a) an extraction electrode disposed at a prescribed distance from a sample holding part for holding a sample;

b) one or a plurality of auxiliary electrodes disposed between the sample holding part and the extraction electrode;

c) a voltage generator for applying prescribed voltages to the sample holding part, the auxiliary electrode, and the extraction electrode to form an electric field for extracting and accelerating ions from the sample surface in a space between the sample holding part and the extraction electrode; and d) a controller for controlling the voltage generator so as to keep the potential of the sample holding part higher than the potential of the extraction electrode by a first potential difference so that an extraction electric field in which ions move in accordance with the mass/charge ratio from the sample surface toward the extraction electrode is formed during a period until a prescribed delay time has passed after the point in time when ion generation is begun, to sequentially increase the potentials of the extraction electrode, the auxiliary electrode, and the sample holding part so that an acceleration electric field in which ions present in the space between the sample holding part and the extraction electrode are simultaneously accelerated in the direction of the extraction electrode and the slope of the potential gradient of the acceleration electric field along the ion optical axis is a relatively larger polygonal line pattern on the sample holding part side than on the extraction electrode side and to make the potential of the sample holding part with respect to the potential of the extraction electrode higher than the first potential difference by a second potential difference at the point in time when the delay time has passed and thereafter.

Here, ionization methods that can be used to generate ions from the sample include methods using a laser beam such as MALDI or LDI, methods using ionic lines such as SIMS, methods using an electrospray flow such as DESI, and methods using plasma such as PDI.

In the typical delayed extraction method used conventionally, the sample holding part and the extraction electrode are maintained at roughly the same potential during the period until a prescribed delay time has passed from the point in time when ion generation is begun, and essentially no electric field is formed in the space between the sample holding part and the extraction electrode. Therefore, the ions generated from the sample are diffused freely in accordance with the initial energy. In contrast, with the time-of-flight type mass spectrometer of the present invention, an extraction electric field which extracts ions from the sample surface in the direction of the extraction electrode is formed in the space between the sample holding part and the extraction electrode at the point in time when ion generation is begun. However, this extraction electric field is not strong enough to accelerate all of the ions simultaneously and at a large acceleration—that is, the slope of the potential gradient along the ion optical axis is gradual—and various ions flying out of the sample move from the sample surface toward the extraction electrode due to the effect of the extraction electric field.

Under a uniform electric field in which the slope of the potential gradient is linear, the speed of the ions is inversely proportional to size. Therefore, under the extraction electric field, smaller ions (typically with a smaller mass/charge ratio) approach the extraction electrode, whereas larger ions are conversely present at positions near the sample. Of course, the initial energy of each ion fluctuates regardless of the mass/charge ratio, and the movement speed is also affected by this initial energy. Therefore, although the respective ions do not form an orderly distribution corresponding to the mass/charge ratio at the point when a prescribed delay time has passed, the spatial distribution is more dependent on the mass/charge ratio than when there is no extraction electric field whatsoever. That is, the spatial expansion of ions having the same mass/charge ratio becomes small.

At the time of the formation of the extraction electric field, an appropriate voltage should be applied so that the slope of the potential gradient is linear, as described above, but it is not necessary to apply a voltage to the auxiliary electrode as long as there is no impediment to the formation of a uniform extraction electric field.

Once a prescribed delay time has passed after the point in time when ions are generated, the voltage generator expands the potential difference between the sample holding part and the extraction electrode so as to simultaneously accelerate the ions under the control of the controller. In addition, an appropriate voltage between the potential of the sample holding part and the potential of the extraction electrode is applied to the auxiliary electrode so that the slope of the potential gradient along the ion optical axis is a relatively larger polygonal line pattern on the sample holding part side than on the extraction electrode side. Immediately before the formation of the acceleration electric field, approximately the same acceleration energy is provided to the same types of ions. Ions with a large mass/charge ratio are located at positions relatively close to the sample, and the slope of the potential gradient is larger in this vicinity than at positions near the extraction electrode, so a larger acceleration energy is provided to ions with a larger mass/charge ratio when the slope of the potential gradient is linear.

As described below, the ideal acceleration electric field for compensating for the initial energies of all of the ions is an electric field of a form in which the potential gradient increases in a curved line from the extraction electrode side toward the sample holding part side and the potential diverges to infinity at certain positions near the sample holding part. In the present invention, as described above, the potential gradient along the ion optical axis between the sample holding part and the extraction electrode is not linear but rather has a polygonal line pattern, so it is possible to increase the degree of approximation with respect to the ideal roughly parabolic potential gradient, which makes it possible to establish a state in which the acceleration energy applied to ions having a relatively large mass/charge ratio, in particular, is nearly ideal. As a result, it is possible to provide various ions with an appropriate acceleration energy corresponding to the mass/charge ratio, which makes it possible to improve the mass resolution over a wide mass/charge ratio range.

Of course, the potential gradient with a polygonal line pattern can be made to approximately approach a parabolic shape as the number of auxiliary electrodes disposed between the extraction electrode and the sample holding part increases. Accordingly, if the complexity of applying different voltages to each auxiliary electrode is permissible, it is preferable to use a configuration in which the number of auxiliary electrodes is increased and an appropriate voltage is applied to each auxiliary electrode.

With the time-of-flight type mass spectrometer of the present invention, when extracting and accelerating ions generated from a sample in an ion source such as a MALDI ion source using a delayed extraction method, not only are fluctuations in the initial energy or initial speed simply corrected, but corrections are also made by changing the kinetic energy corresponding to the mass/charge ratio, which makes it possible to improve the mass resolution over a wider mass/charge ratio range than with a typical delayed extraction method that is used conventionally.

DETAILED DESCRIPTION OF THE EXEMPLARY EMBODIMENTS

Figure 3:
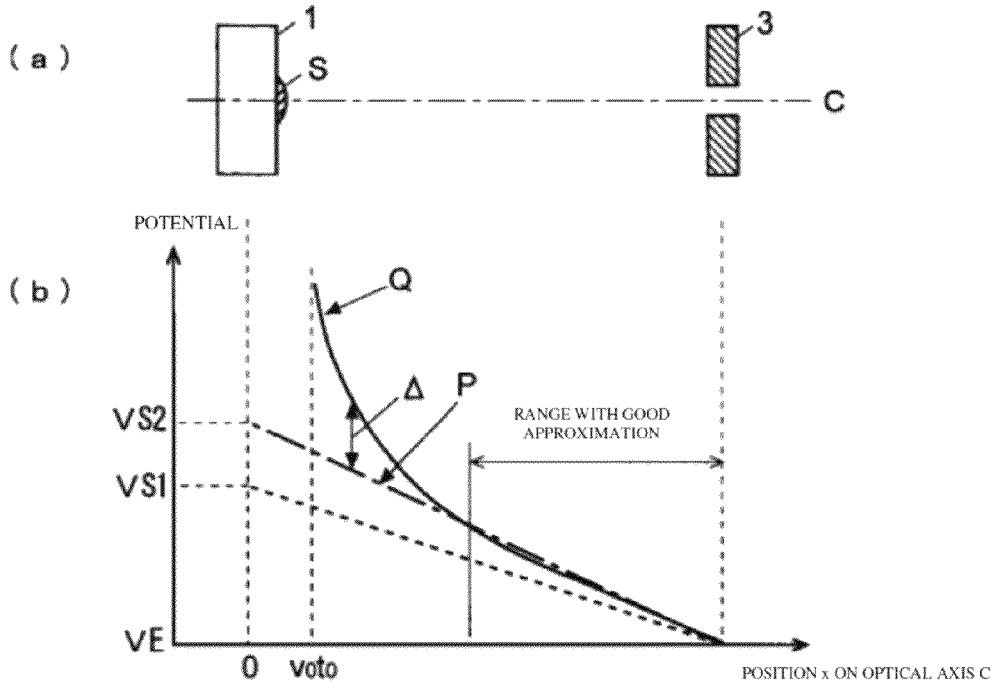
FIG. 3 is an explanatory diagram of the slope field delay extraction operation proposed previously.
Figure 4:
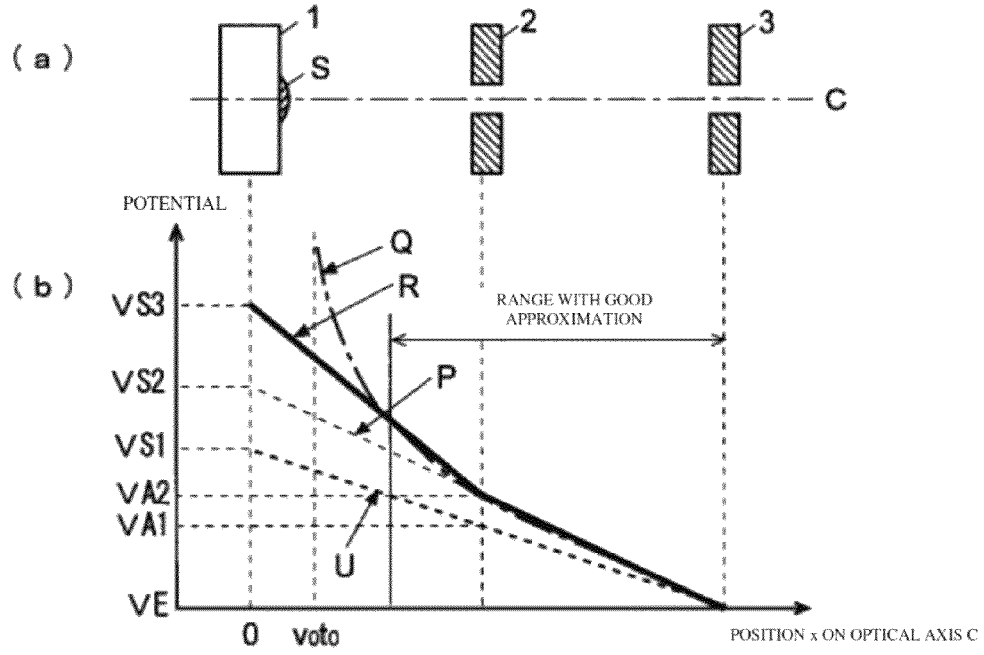
FIG. 4 is an explanatory diagram of the ion acceleration operation in the MALDI-TOFMS of this embodiment.

First, the limits of energy compensation by the aforementioned slope field delayed extraction method proposed previously and the principle of the new slope field delayed extraction method used in the TOFMS of the present invention will be explained with reference to FIGS. 3 and 4 in addition to FIG. 7. FIG. 3 is an explanatory diagram of the slope field delay extraction operation proposed previously, and FIG. 4 is an explanatory diagram of the slope field delay extraction operation [sic: is an explanatory diagram of the ion acceleration operation in the MALDI-TOFMS] of the present invention.

Figure 7:
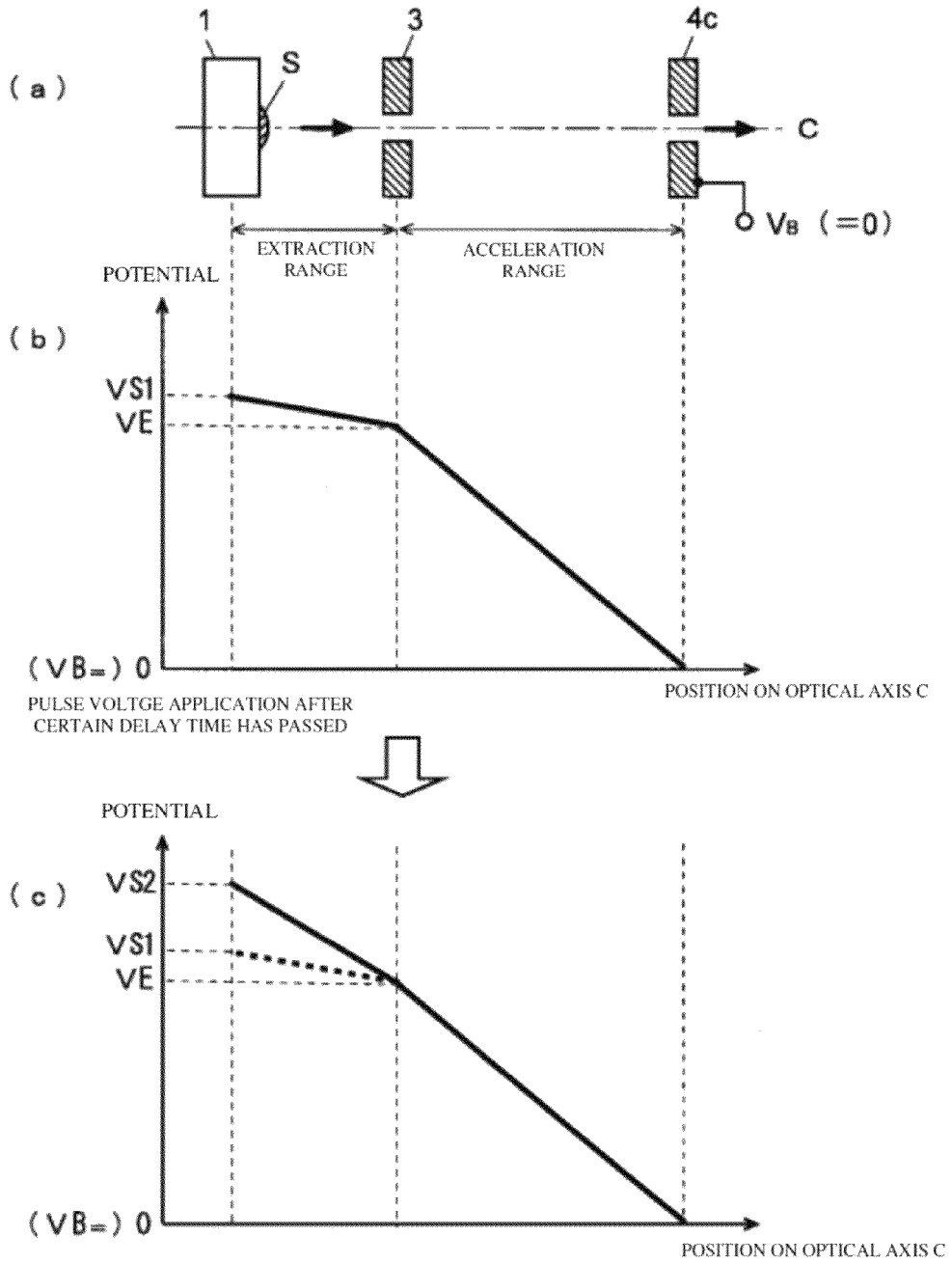
FIG. 7 is an explanatory diagram of the ion acceleration operation according to the slope field delayed extraction method proposed previously.

As illustrated in FIGS. 7(*b*) and (*c*), in the slope field delayed extraction method, an extraction electric field in the extraction region during the period until a prescribed delay time has passed from the time of laser beam irradiation is an electric field demonstrating a potential gradient that decreases linearly from a sample plate 1 toward an extraction electrode 3, and the acceleration electric field formed when the voltage applied to the sample plate 1 is increased after a prescribed delay time has passed is also an electric field having a potential gradient that slopes downward linearly from the sample plate 1 toward the extraction electrode 3. The only difference is the slope of the potential gradient. When the potential gradient of the acceleration electric field is linear in this way, initial energy compensation is not realized for ions of all mass/charge ratios. Therefore, it will be discussed how the acceleration electric field for simultaneously accelerating ions and feeding the ions from the extraction region becomes in ideal situations.

First, when the potential of the sample plate 1 prior to the formation of the acceleration electric field—that is, at the time of the formation of the extraction electric field—is set to VS1, the potential gradient of the extraction electric field on the ion optical axis C at this time becomes linear, so the strength of the uniform electric field is set to $E_0$. Since the extraction electric field operates from the sample plate 1 toward the extraction electrode 3, the potential $V_0(x)$ on the ion optical axis C between the sample plate 1 and the extraction electrode 3 is expressed by the following formula (1) when the distance from the sample plate 1 is defined as x.

$$v_0(x)=VS1-E_0x \tag{1}$$

In addition, defining the initial speed of the ions as $v_0$, the charge as q, the mass as m, and the initial position on the surface of the sample plate 1 as x=0, when an acceleration voltage is applied after time $t_0$ has passed from the time of ion generation due to laser beam irradiation (the voltage applied to the sample plate 1 is increased from VS1 to VS2), the speed v of the ions at that time is accelerated by the electric field $E_0$ and is therefore expressed by formula (2).

$$v=v_0+(qE_0/m)t_0 \tag{2}$$

The position x of the ions is expressed by formula (3).

$$x=v_0t_0+(1/2)(qE_0/m)t_0^2 \tag{3}$$

Further, when the initial speed of ions with the same mass has the fluctuation $v_0+\Delta v_0$, the following formula (4) is found from formula (3), where the fluctuation in the position at time $t_0$ is defined as $+\Delta x$.

$$\{x+\Delta x\}-\{x-\Delta x\}=\{(v_0+\Delta v_0)t_0+(1/2)(qE_0/m)t_0^2\}-\{(v_0-\Delta v_0)t_0+(1/2)(qE_m/m)t_0^2\} \tag{4}$$

In addition, the difference $\Delta K_0$ in the initial kinetic energy of two ions of the same mass having initial speeds of $v_0+\Delta v_0$ and $v_0-\Delta v_0$, respectively, is expressed by the following formula (5).

$$\Delta K_0=(1/2)m(v_0+\Delta v_0)^2-(1/2)m(v_0-\Delta v_0)^2=2mv_0\Delta v_0 \tag{5}$$

When this difference ΔK0 in kinetic energy is compensated for with a pulse voltage ΔV(x), the energy obtained by the pulse voltage at position x is qΔV(x), so the following formula (6) is derived from formulas (4) and (5).

$$q\Delta V=(x-\Delta x)-q\Delta V(x+\Delta x)=\Delta K_0=2mv_0\Delta v_0=\{2mv_0/t_0)\Delta x$$

$$\{\Delta V(x+\Delta x)-\Delta V(x-\Delta x)\}/2\Delta x=-(v_0/qt_0)m \tag{6}$$

On the other hand, m is expressed by the following formula (7) from formula (3).

$$m=(1/2)\{qE_0t_0^2/(x-v_0t_0)\} \tag{7}$$

Accordingly, when $\Delta x\rightarrow 0$, formula (8) is obtained by substituting formula (7) into formula (6).

$$d\Delta V(x)/dx=-(E_0v_0t_0/2)\{1/(x-V_0t_0)\} \tag{8}$$

By integrating formula (8), ΔV(x) can be expressed by formula (9).

$$\Delta V(x)=-(E_0v_0t_0/2)\ln\{(x-v_0t_0)/C\} \tag{9}$$

Here, C is an integration multiplier. Accordingly, the potential $V_1(x)$ after the formation of the acceleration electric field is expressed by formula (10).

$$V_1(x)=V_0(x)+\Delta V(x)=VS2-E_0[x+(v_0t_0/2)\ln\{(x-v_0t_0)/C\}] \tag{10}$$

It can be understood from this formula (10) that when the difference in kinetic energy due to fluctuations in initial speed is compensated for with an acceleration voltage (energy) after ions are separated by mass with a potential demonstrating a linear slope, the potential on the ion optical axis C after the formation of the acceleration electric field is a curve that diverges to infinity at the position $x=v_0t_0$. This position $x=v_0t_0$ is a position where virtual ions of infinite mass m are present at the time of the formation of the acceleration electric field. This curve is represented by Q in FIGS. 3 and 4.

The electric field demonstrating the potential expressed by formula (10) only has a compensating effect for the initial kinetic energy, so ions of the same mass do not fly at the same speed and converge in time in the free flight space. That is, in the theory described above, the convergence point is located at the position at infinity. Therefore, in order to make the flight time of ions having the same mass converge at a given point, it is necessary to further provide ions having slower initial speeds with an even larger energy than the energy compensated for with the potential of formula (10). However, in this case as well, it can be easily presumed that the function expressing the potential will diverge to infinity at $x=v_0t_0$, as in formula (10).

As described above, since the ideal potential of the acceleration electric field after the formation of the acceleration electric field diverges to infinity at the position $x=v_0t_0$, as illustrated in FIG. 3(*a*), the range over which the curve Q can be approximated with a potential gradient P demonstrating a simple linear slope is not very wide. At the time of the formation of the acceleration electric field, sufficient energy compensation is realized for ions in a range in which this approximation is favorable, but energy compensation is not sufficiently realized for ions at positions deviating from this range. In other words, even of the slope field delayed extraction method described above is used, the mass resolution improving effect provided by energy compensation cannot be expected for ions having a relatively large mass/charge ratio positioned outside the range where approximation is favorable in the extraction region immediately before the acceleration voltage is applied.

Therefore, in the TOFMS of the present invention, in order to realize a potential gradient as close as possible to the ideal potential gradient which diverges to infinity at the position $x=v_0t_0$, as illustrated in FIG. 4(*a*), an auxiliary electrode 2 is newly disposed between the sample plate 1 and the extraction electrode 3, and a DC voltage differing from that of the sample plate 1 and the extraction electrode 3 is applied to the auxiliary electrode 2 so as to form a DC electric field with a different potential gradient slope in the space between the sample plate 1 and the auxiliary electrode 2 and in the space between the auxiliary electrode 2 and the extraction electrode 3. That is, as illustrated in FIG. 4(*b*), by applying a voltage VA2 to the auxiliary electrode 2 and applying a voltage VS3 (VS3>VS1, VS2) to the sample plate 1, the potential gradient R of the acceleration electric field formed in the extraction region assumes a polygonal line pattern bending back at the position of the auxiliary electrode 2. As a result, the potential gradient R of the acceleration electric field in the extraction region is a favorable approximation of the ideal potential gradient curve Q described above, which makes it possible to expand the mass charge/ratio range over which the mass resolution can be improved by means of energy compensation.

Figure 1:
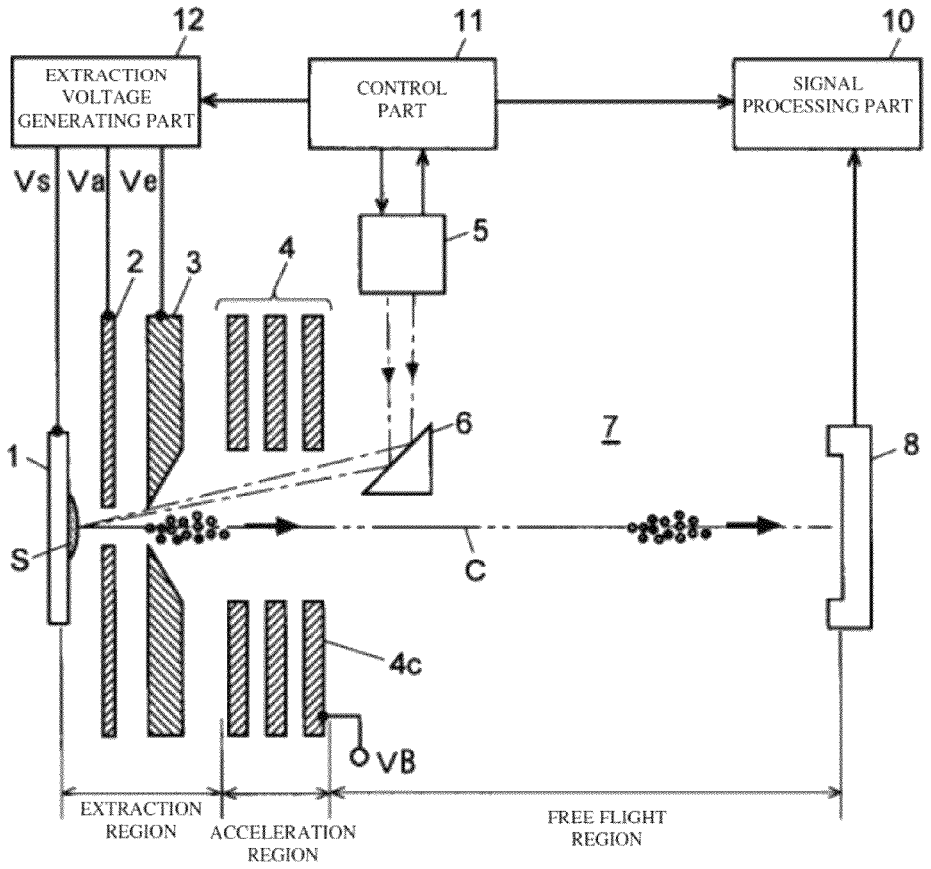
FIG. 1 is a schematic diagram of a MALDI-TOFMS serving as an embodiment of the present invention.

The MALDI-TOFMS of an embodiment of the present invention using a new slope field delayed extraction method employing the principle described above will be described with reference to FIG. 1. FIG. 1 is a schematic diagram of the MALDI-TOFMS of this embodiment.

In the MALDI-TOFMS of this embodiment, an auxiliary electrode 2, an extraction electrode 3, an ion optical system 4, a flight space 7, and a detector 8 are disposed along the ion optical axis C roughly orthogonal to the sample plate 1 holding the sample S. Under the instruction of a control part 11, a laser beam emitted from a laser irradiation part 5 is reflected by a mirror 6 so that a region with a minute diameter on the surface of the sample S is irradiated. The sample plate 1 is made of metal or a conductive glass and is held by a stage not illustrated in the drawing. A voltage is applied through this stage, but for the sake of convenience in FIG. 1, the voltage is shown as being applied directly to the sample plate 1.

Figure 6:
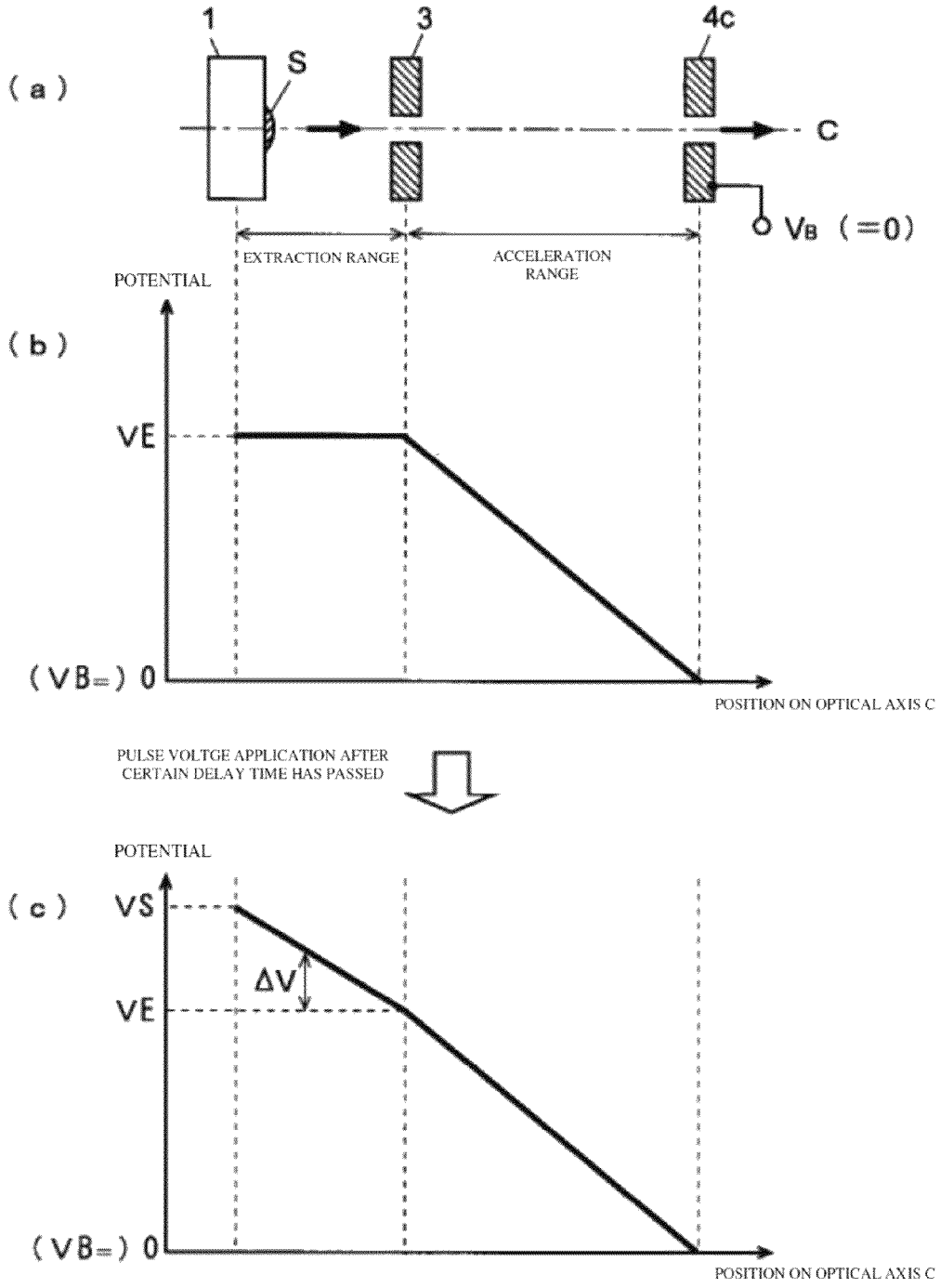
FIG. 6 is an explanatory diagram of the ion acceleration operation according to a typical delayed extraction method that is used conventionally.

In accordance with an instruction of the control part 11, an extraction voltage generating part 12 applies prescribed DC voltages to the sample plate 1, the auxiliary electrode 2, and the extraction electrode 3, respectively. The ion optical system 4 consists of a plurality of electrodes including a base electrode 4*c* to which a prescribed potential (VB) is provided, and the ions are made to converge in the vicinity of the ion optical axis C by suppressing the spread of the ions with a voltage applied to these electrodes from a power supply part not illustrated in the drawing. As in FIG. 6, the potential (VB) of the base electrode 4*c* is also 0 in this example. The detector 8 is a photoelectron multiplier which detects ions that sequentially reach the detector 8 after being separated over time in accordance with the mass/charge ratio in the process of passing through the flight space 7 and transmits a detection signal corresponding to the amount of ions to a signal processing part 10. The signal processing part 10 creates a flight time spectrum indicating the relationship between the flight time and the ion strength based on the detection signal and creates a mass spectrum by converting the flight time into a mass/charge ratio based on predetermined calibration information.

The analysis operation including the delayed extraction/acceleration operation characteristic to the MALDI-TOFMS of this embodiment will be described hereinafter.

When a start signal is transmitted from the control part 11 to the laser irradiation part 5, the laser irradiation part 5 emits a laser beam with a prescribed pulse with in accordance with the signal. This laser beam is reflected by the mirror 6 so as to irradiate the sample S on the sample plate 1. On the other hand, when the laser beam is emitted, a signal obtained by monitoring a very small part of the laser beam is fed back into the control part 11 from the laser irradiation part 5, and the control part 11 thereby recognizes the laser emission. The control part 11 then recognizes that this point in time is the ion generation start time and starts keeping time with an internal timer.

At an appropriate time before the sample is irradiated with the laser beam, the control part 11 controls the extraction voltage generating part 12 so as to set the voltage Ve applied to the extraction electrode 3 to VE, the voltage Vs applied to the sample plate 1 to VS1, which is higher than VE, and to set the voltage Va applied to the auxiliary electrode 2 to a prescribed voltage VA1, which is equal to or greater than VE and equal to or less than VS1. Whereas VS=VE in the typical delayed extraction method used conventionally, VS1>VE in this embodiment. However, the potential difference VS1−VE at this time is much smaller than the potential difference VS3−VE at the time of ion acceleration described below. The reason for this is described below. The voltage VB of the base electrode 4*c* is 0. The potential distribution on the ion optical axis C has a linear shape indicated by U in FIG. 4(*b*). That is, an extraction electric field having a potential gradient that slopes downward gradually and linearly from the sample plate 1 toward the extraction electrode 3 is formed in the space (extraction region) between the sample plate 1 and the extraction electrode 3, and an electric field having a potential gradient that slopes downward abruptly from the extraction electrode 3 toward the base electrode 4*c* is formed in the space (acceleration region) between the extraction electrode 3 and the base electrode 4*c*. This extraction electric field is the same as in the case of the previously proposed slope field delayed extraction method illustrated in FIG. 7(*b*).

When the sample S is irradiated with a laser beam, the matrix in the sample S and the target sample are both vaporized, and the target sample is thereby ionized. Since the extraction electric field described above acts on various ions generated in the narrow space in the vicinity of the surface of the sample S, the ions are attracted in the direction of the extraction electrode 3 (right direction in FIG. 4(*a*)). At this time, the speed of the ions derived from the potential energy provided by the extraction electric field is larger when the mass/charge ratio is small. Therefore, ions with a smaller mass/charge ratio approach the extraction electrode 3.

Figure 8:
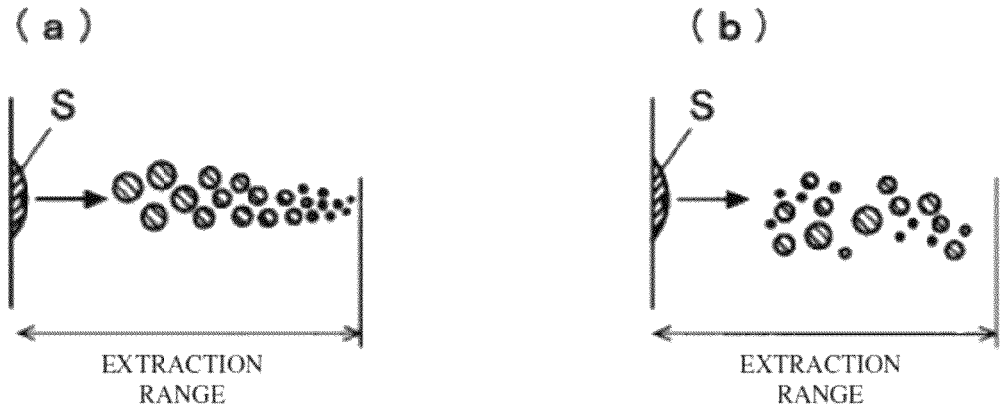
FIG. 8 is a conceptual diagram illustrating the ion spatial distribution at the time of ion extraction.

Of course, each ion has an initial energy that is independent of the mass/charge ratio at the time of generation, and there is also a corresponding speed component, so the ions are not simply arranged in order of the mass/charge ratios. However, when observing ions having different mass/charge ratios to which the same initial energy was provided at the time of ion generation, for example, ions with a smaller mass/charge ratio approach the extraction electrode 3 more quickly. Therefore, on the whole, as illustrated in FIG. 8(*a*), ions with a smaller mass/charge ratio (drawn with a small size in FIG. 8) precede the other ions, and ions with a larger mass/charge ratio (drawn with a large size in FIG. 8) are located at positions relatively close to the sample S. When groups of ions having roughly the same mass/charge ratio are observed in detail, ions having a larger initial energy are present at positions closer to the extraction electrode 3.

If the slope of the potential gradient of the extraction electric field is too steep at the time of ion generation, each ion will be accelerated immediately after being generated and will pass through the extraction electrode 3 in a short period of time. In other words, this is not essentially delayed extraction. Therefore, the slope of the potential gradient is made gradual so as to provide ions with a kinetic energy of a degree that does not allow ions extracted from the vicinity of the surface of the sample S to pass through the extraction electrode 3 until the delay time described below has passed. That is, it is necessary to make the potential difference VS1−VE small in FIG. 4(*b*). On the other hand, if VS1−VE is too small and the slope of the potential gradient is too gradual, the effects of the initial energy of ions will become greater than the kinetic energy received by the ions due to the extraction electric field, and the ions will not be separated in accordance with the mass/charge ratio. Therefore, it is preferable to determine the potential difference VS1−VE appropriately so that various ions are separated to a moderate degree in accordance with the mass/charge ratio within the delay time in the extraction region based on conditions such as the delay time and the distance between the sample plate 1 and the extraction electrode 3. When this is determined, the voltage VA1 applied to the auxiliary electrode 2 is determined uniquely. The appropriate potential difference VS1−VE described above can be determined with simulated calculations described above experimentally with an actual device, for example, as described below.

Once a prescribed delay time t has passed after the control part 11 starts keeping time with the internal timer, the control part 11 controls the extraction voltage generating part 12 so as to increase the voltage Vs applied to the sample plate 1 from the previous level of VS1 to VS3 and to increase the voltage Va applied to the auxiliary electrode 2 from the previous value of VA1 to VA2. On the other hand, the voltage VE applied to the extraction electrode 3 is maintained at the same voltage level as before. As a result, the potential distribution on the ion optical axis C changes to the state indicated by R in FIG. 4(*b*). That is, an acceleration electric field is formed in the extraction region, the electric field having a potential gradient with a polygonal line pattern which slopes downward abruptly from the sample plate 1 toward the extraction electrode 3, wherein the slope between the sample plate 1 and the auxiliary electrode 2 is greater than the slope between the auxiliary electrode 2 and the extraction electrode 3.

As a result, an acceleration voltage reaching a maximum of VS3−VE is simultaneously provided to ions present in the extraction region immediately before, and the ions are thereby extracted toward the extraction electrode 3. Further, after the ions enter the acceleration region, the ions are further accelerated by the potential difference VE−VB (=VE) between the potential of the extraction electrode 3 and the potential VB (=0) of the base electrode 4*c* and are fed into the flight space 7. The ions introduced into the flight space 7 are separated during flight in accordance with the mass/charge ratio, and the ions then reach the detector 8. A larger acceleration energy is provided to ions present at positions closer to the sample plate 1 in the extraction region, and the acceleration voltage approaches the ideal state for realizing energy compensation for ions having a large mass/charge ratio. As a result, ions with a larger mass/charge ratio are fed into the flight space 7 at a higher speed, and if the mass/charge ratio is the same, ions with a smaller initial energy are fed into the flight space 7 at a higher speed.

Ions with a relatively large mass/charge ratio present at positions near the sample plate 1 in the extraction region are introduced into the flight space 7 later in time than ions of the same mass/charge ratio that are present at locations closer to the extraction electrode 3. However, since the flight speed is large, the ions gradually catch up to the preceding ions during flight and are able to reach the detector 8 at approximately the same time. That is, energy convergence can be realized for ions of the same mass/charge ratio.

Since a relatively high acceleration energy is provided to ions with a large mass/charge ratio in comparison to ions with a small mass/charge ratio, and since the potential gradient R of the acceleration electric field that is formed approximates the ideal potential gradient curve Q over a wide range, as illustrated in FIG. 4(*b*), it is possible to provide appropriate changes in potential energy to each of the ions contained in a wide mass/charge ratio range. As a result, it is possible to reduce differences in the correction effect on fluctuations in initial speed due to the mass/charge ratio for ions over a wide mass/charge ratio range. This makes it possible to reduce fluctuations in initial speed over a wide mass/charge ratio range, without being biased toward a specific mass/charge ratio, which makes it possible to achieve a high mass resolution.

The shape of the ideal potential gradient curve Q and the position of $v_0t_0$ are also affected by the ionization conditions; in particular, the type of matrix used in the preparation of the sample S, the power of the laser beam, and the like. Accordingly, a calibration operation for performing analysis on a reference sample or the like under the same ionization conditions as when analyzing the target sample should be executed, and appropriate values of the voltages VS3, VA2, and the like should be found based on the results.

Next, a simulation for verifying the effects of the delayed extraction operation in the MALDI-TOFMS of this embodiment will be described. In this simulation, an ion transport system having axial symmetry around the ion optical axis C illustrated in FIG. 1 is presumed, and the distance of the free flight orbit in the linear flight space 7 was set to approximately 1,200 (mm). In addition, numerical calculations were performed for the time taken by ions to reach the detector 8 while changing the mass/charge ratio in increments of 100 (Da) over a mass/charge ratio range from 500 to 5,000 (Da), and the resolution was investigated. A range over which the resolution exceeds 5,000 was used as a target for a mass/charge ratio range indicating effective delayed extraction, and the parameters (applied voltages) of each delayed extraction method—that is, the new slope field delayed extraction method (present invention), the slope field delayed extraction method proposed previously, and the conventional delayed extraction method—were adjusted so that the lower limit of the mass/charge ratio range was approximately 1,000 (Da).

Figure 2:
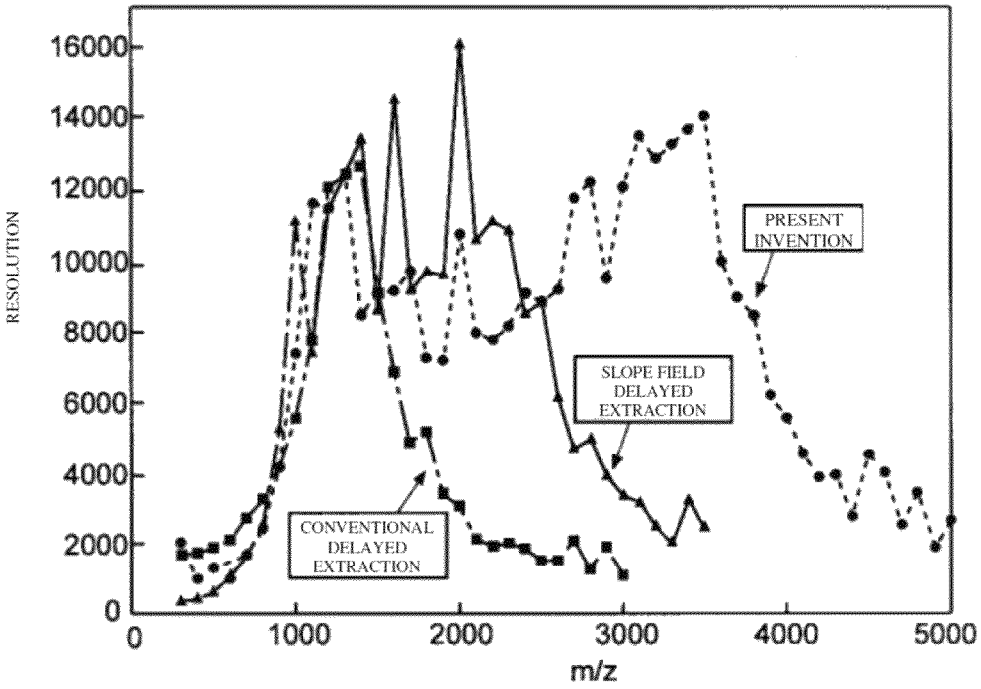
FIG. 2 illustrates the results of a simulation for verifying the effects of the MALDI-TOFMS of this embodiment.

FIG. 2 illustrates the results of this simulation. With the conventional method, the upper limit of the mass/charge ratio exceeding a resolution of 5,000 is 1,800 (Da), and the mass/charge ratio range is only 800 (Da). In contrast, with the slope field delayed extraction method proposed previously, the upper limit of the mass/charge ratio exceeding a resolution of 5,000 is 2,800 (Da), and the mass/charge ratio range is 1,800 (Da), which indicates an expansion of the mass/charge ratio range by over two times that of the conventional method. Further, with the new slope field delayed extraction method of the present invention, the upper limit of the mass/charge ratio exceeding a resolution of 5,000 is 4,000 (Da), and the mass/charge ratio range is as high as 3,000 (Da). This indicates that the mass/charge ratio range is over three times as wide as that of the conventional method and over 1.5 times as wide as that of the slope field delayed extraction method proposed previously, and it can be confirmed that effects sufficiently higher than those of the previous delayed extraction method can be achieved.

Figure 5:
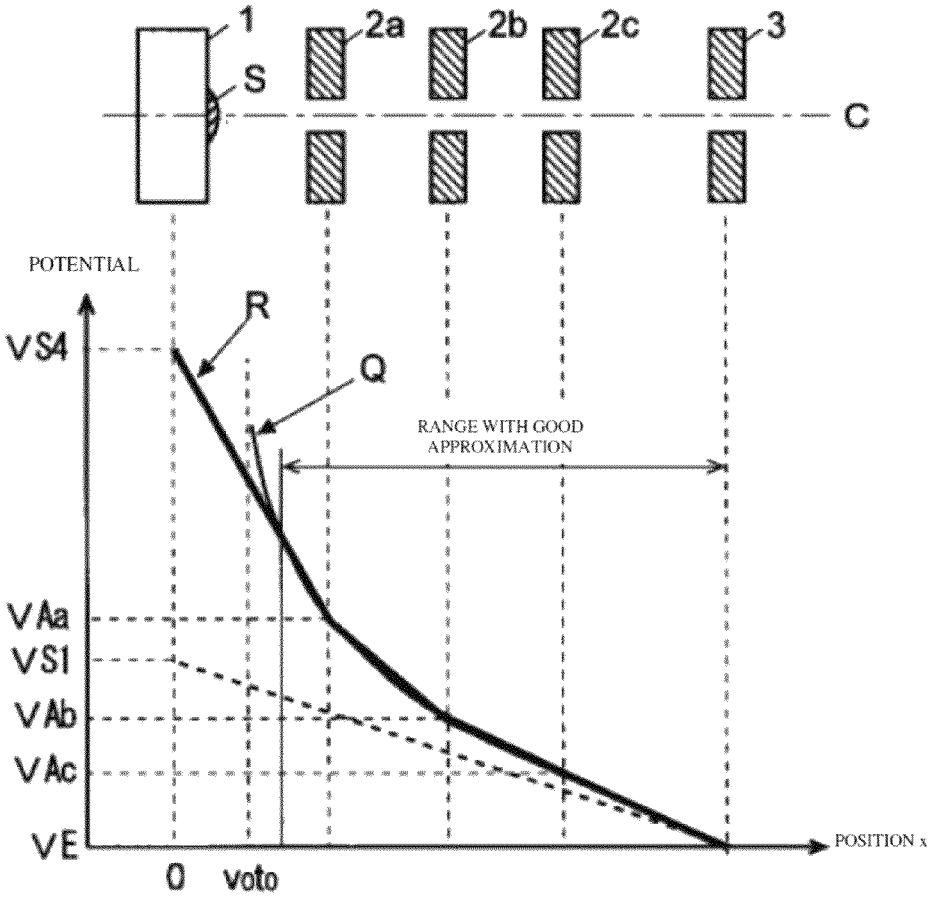
FIG. 5 is an explanatory diagram of the ion acceleration operation of a MALDI-TOFMS of another embodiment.

In this embodiment, only one auxiliary electrode 2 was provided between the sample plate 1 and the extraction electrode 3, but as illustrated in FIG. 5, a plurality (three in the example of FIG. 5) of auxiliary electrodes 2*a*, 2*b*, and 2*c* may be provided along the ion optical axis C, and appropriate voltages VAa, VAb, and VAc may be respectively applied to each of the auxiliary electrodes 2*a*, 2*b*, and 2*c* at the time of the formation of the acceleration electric field. As a result, it is possible to more closely approximate the potential gradient with a polygonal line pattern with the ideal potential gradient curve Q, which makes it possible to further expand the mass/charge ratio range over which a high resolution can be realized.

All of the embodiments described above are examples of the present invention, and it goes without saying that any appropriate variations, modifications, and additions within the scope of the gist of the present invention are also included in the Scope of the Patent Claims of this application.

EXPLANATION OF REFERENCES

1 . . . sample plate
S . . . sample

2, 2*a*, 2*b*, 2*c* . . . auxiliary electrodes
3 . . . extraction electrode
4 . . . ion optical system
4*c* . . . base electrode
5 . . . laser irradiation part
6 . . . mirror
7 . . . flight space
8 . . . detector
10 . . . signal processing part
11 . . . control part
12 . . . extraction voltage generating part
C . . . ion optical axis

What is claimed is:

1. A time-of-flight type mass spectrometer for accelerating ions generated from a sample, introducing the ions into a flight space, and separating and detecting the ions in accordance with a mass/charge ratio within the flight space, the time-of-flight type mass spectrometer comprising:

a) an extraction electrode disposed at a prescribed distance from a sample holding part for holding a sample;

b) one or a plurality of auxiliary electrodes disposed between the sample holding part and the extraction electrode;

c) a voltage generator for applying prescribed voltages to the sample holding part, the auxiliary electrode, and the extraction electrode to form an electric field for extracting and accelerating ions from the sample surface in a space between the sample holding part and the extraction electrode; and d) a controller for controlling the voltage generator so as to keep the potential of the sample holding part higher than the potential of the extraction electrode by a first potential difference so that an extraction electric field in which ions move in accordance with the mass/charge ratio from the sample surface toward the extraction electrode is formed during a period until a prescribed delay time has passed after the point in time when ion generation is begun, to sequentially increase the potentials of the extraction electrode, the auxiliary electrode, and the sample holding part so that an acceleration electric field in which ions present in the space between the sample holding part and the extraction electrode are simultaneously accelerated in the direction of the extraction electrode and the slope of the potential gradient of the acceleration electric field along the ion optical axis is a relatively larger polygonal line pattern on the sample holding part side than on the extraction electrode side and to make the potential of the sample holding part with respect to the potential of the extraction electrode higher than the first potential difference by a second potential difference at the point in time when the delay time has passed and thereafter.

2. The time-of-flight type mass spectrometer according to claim 1, wherein the ionization performed on the sample is performed with one ionization method selected from a MALDI method, an LDI method, a DESI method, a PDI method, and an SIMS method.

* * * * *